US007018238B1

(12) United States Patent
Zhi-xuan

(10) Patent No.: US 7,018,238 B1
(45) **Date of Patent: *Mar. 28, 2006**

(54) THIN CONNECTOR

(75) Inventor: Hsieh Zhi-xuan, Shulin (TW)

(73) Assignee: L & K Precision Technology Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/130,086

(22) Filed: May 17, 2005

(51) Int. Cl.
*H01R 13/648* (2006.01)

(52) U.S. Cl. ..... 439/607

(58) Field of Classification Search ..... 439/607
See application file for complete search history.

(56) References Cited

U.S. PATENT DOCUMENTS 6,811,439 B1 * 11/2004 Shin-Ting ..... 439/607
6,840,792 B1 * 1/2005 Kuan ..... 439/404

* cited by examiner

*Primary Examiner*—Tho D. Ta
(74) *Attorney, Agent, or Firm*—Troxell Law Office, PLLC

(57) ABSTRACT

A thin connector has an insulative housing, a plurality of conductive terminals received in the insulative housing, and a shell shielding the insulative housing and the conductive terminals. The shell has partitions accommodated in the insulative housing below the conductive terminals for shielding the conductive terminals thereby effectively reducing cross talking therebetween. The shell forms assembling arms on both sides thereof for interferentially assembled on the assembling holes of the insulative housing. Assembling grooves are defined in the assembling arms for locking with a mating connector. The thin connector diminishes overall height and achieves stable signal transmission.

7 Claims, 6 Drawing Sheets

THIN CONNECTOR

BACKGROUND OF THE INVENTION

1. Field of the Invention

The present invention relates to a thin connector, and particularly to a thin connector which is assembled on a printed circuit board (PCB) for communicating with a Liquid Crystal Display (LCD) and which has simplified structure and shields from interference.

2. Related Art

A connector, which is assembled on a mainboard for communicating with LCD, is always required to transfer numerous data. Correspondingly, such a connector has a number of conductive terminals thereon. The connector is often required to have small size, so the conductive terminals have to be mounted closely. However, conductive terminals being mounted closely is most likely to produce cross talking, resulting in unreliable signal transmission.

Moreover, the connector usually has a metal shield around an insulative housing for avoiding external interference thereby assuring transmission quality; however, a height of the insulative housing is limited to a required height due to current moulding processing, and plus the metal shield cover outside, which cause the height of the connector unable to be minimized.

SUMMARY OF THE INVENTION

Accordingly, an object of the present invention is to provide a thin connector having reliable shielding performance and having simplified structure and low profile.

To achieve the above-mentioned objects, the thin connector of the present invention comprises an insulative housing, a plurality of conductive terminals received in the insulative housing and a shell shielding the insulative housing and the conductive terminals. The insulative housing defines assembling holes therein and receiving space adjacent to the assembling holes and toward the mating wall.

The shell forms assembling arms on both sides thereof for corresponding to the assembling holes of the insulative housing. The assembling arms have front portions interferentially assembled inside the assembling holes of the insulative housing. Assembling grooves are defined in rear portions of the assembling arms for locking with a mating connector. The receiving space and the shell define a locking groove for locking with the mating connector.

DESCRIPTION OF THE PREFERRED EMBODIMENTS

Figure 1:
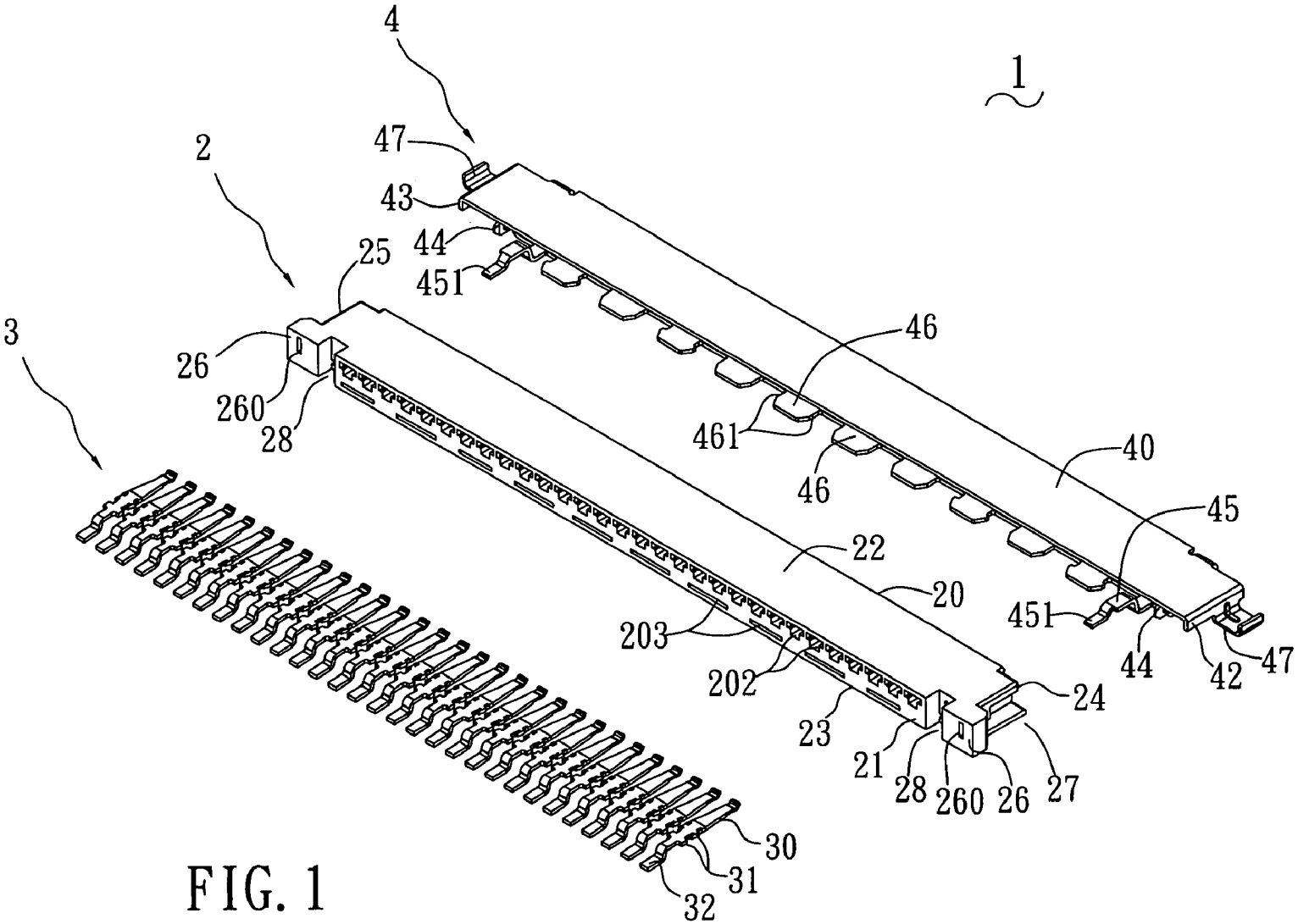
FIGS. 1 and 2 are exploded views of a thin connector of the present invention from different aspects.
Figure 4:
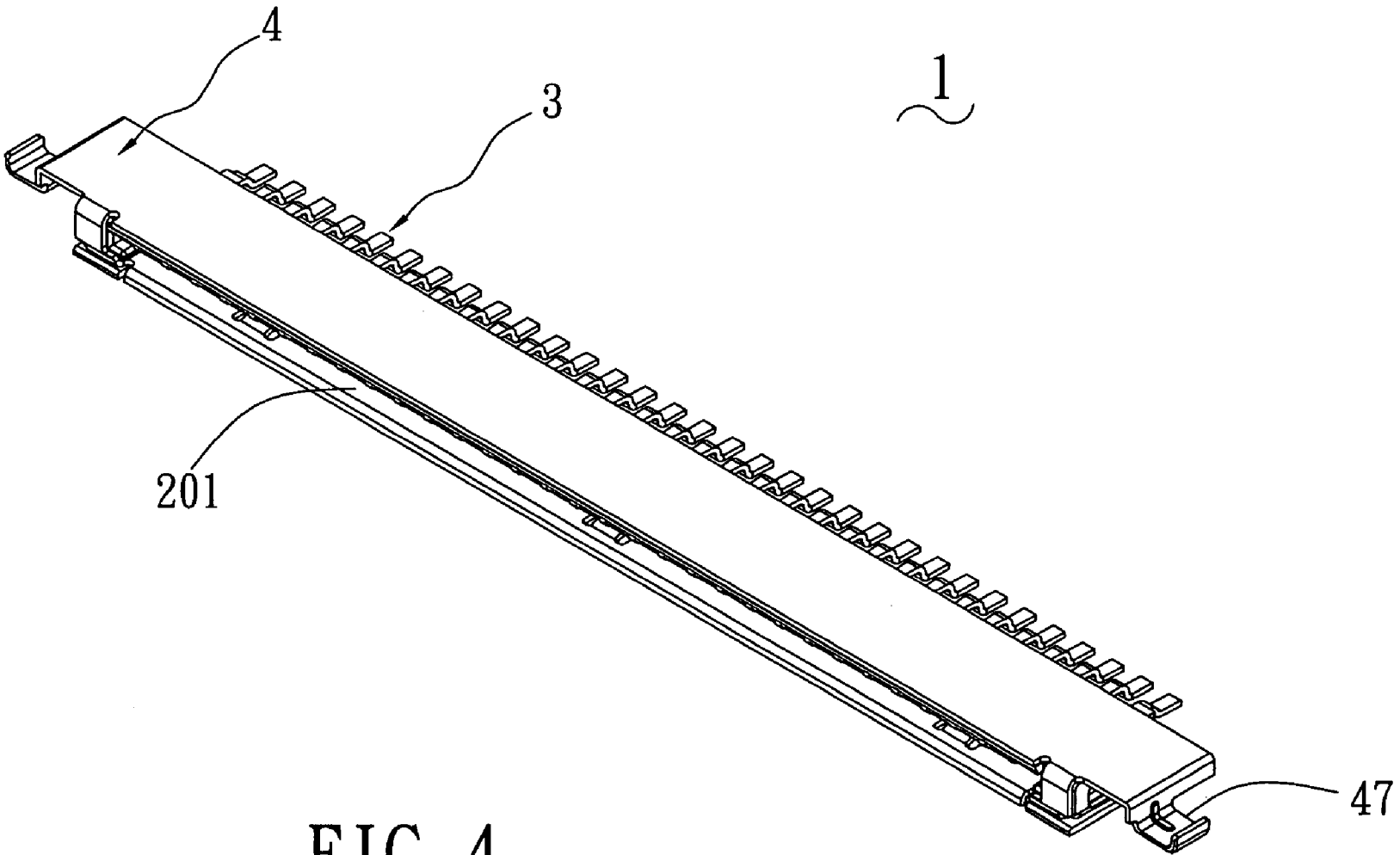

With reference to FIG. 1, a thin connector 1 of the present invention comprises an insulative housing 2, a plurality of conductive terminals 3 and a shell 4. The insulative housing 2 is substantially rectangular and has long sides and short sides. A mating wall 20 and a connecting wall 21 are respectively located at long sides opposite to each other. The insulative housing 2 further forms a top wall 22 at a top, a bottom wall 23 at a bottom, and a pair of side walls 24, 25 at both sides, which are between the mating wall 20 and the connecting wall 21. Engaging blocks 26 respectively extend outwardly from opposing ends of the connecting wall 21. Each engaging block 26 defines an upright and rectangular assembling hole 260, and receiving space 27 toward the mating wall 20 and adjacent to the assembling hole 260. An opening 201 (shown in FIG. 4) is defined longitudinally through the mating wall 20 for accommodating a mating connector (not shown). A plurality of passageways 202 (shown in FIG. 5) is transversely defined through the mating wall 20 and the connecting wall 21 for receiving the conductive terminals 3 therein. A plurality of plug holes 203 is transversely defined below the passageways 202 and is spaced equally apart from each other. Positioning notches 28 are respectively defined in the insulative housing 2 and adjacent the side walls 24, 25. The conductive terminals 3 are received in the passageways 202, and each conductive terminal 3 has a contact portion 30, a soldering portion 32 and an interferential portion 31 between the contact portion 30 and the soldering portion 32. The soldering portion 31 bends appropriately for surface mounting.

Figure 2:
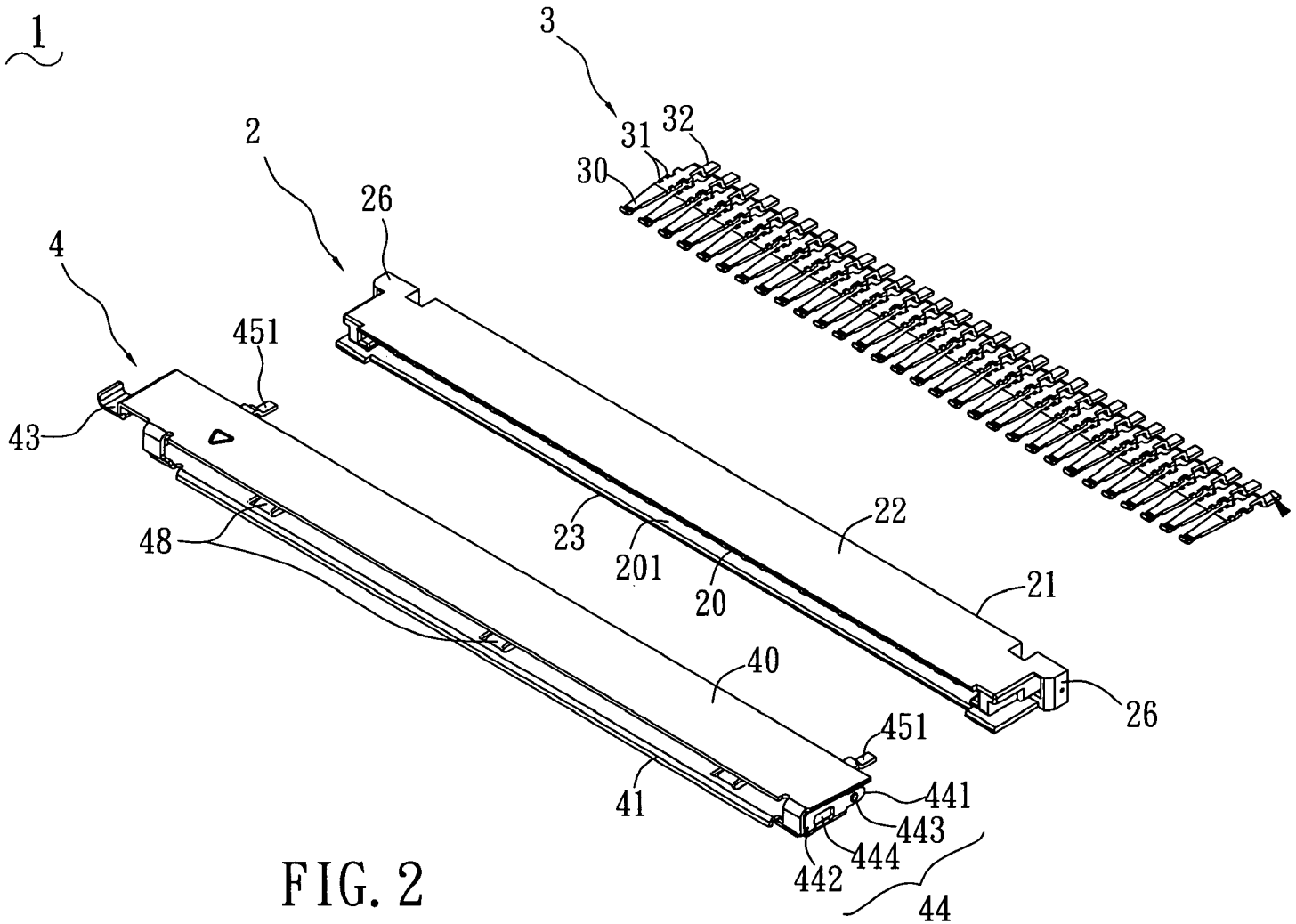
Figure 3:
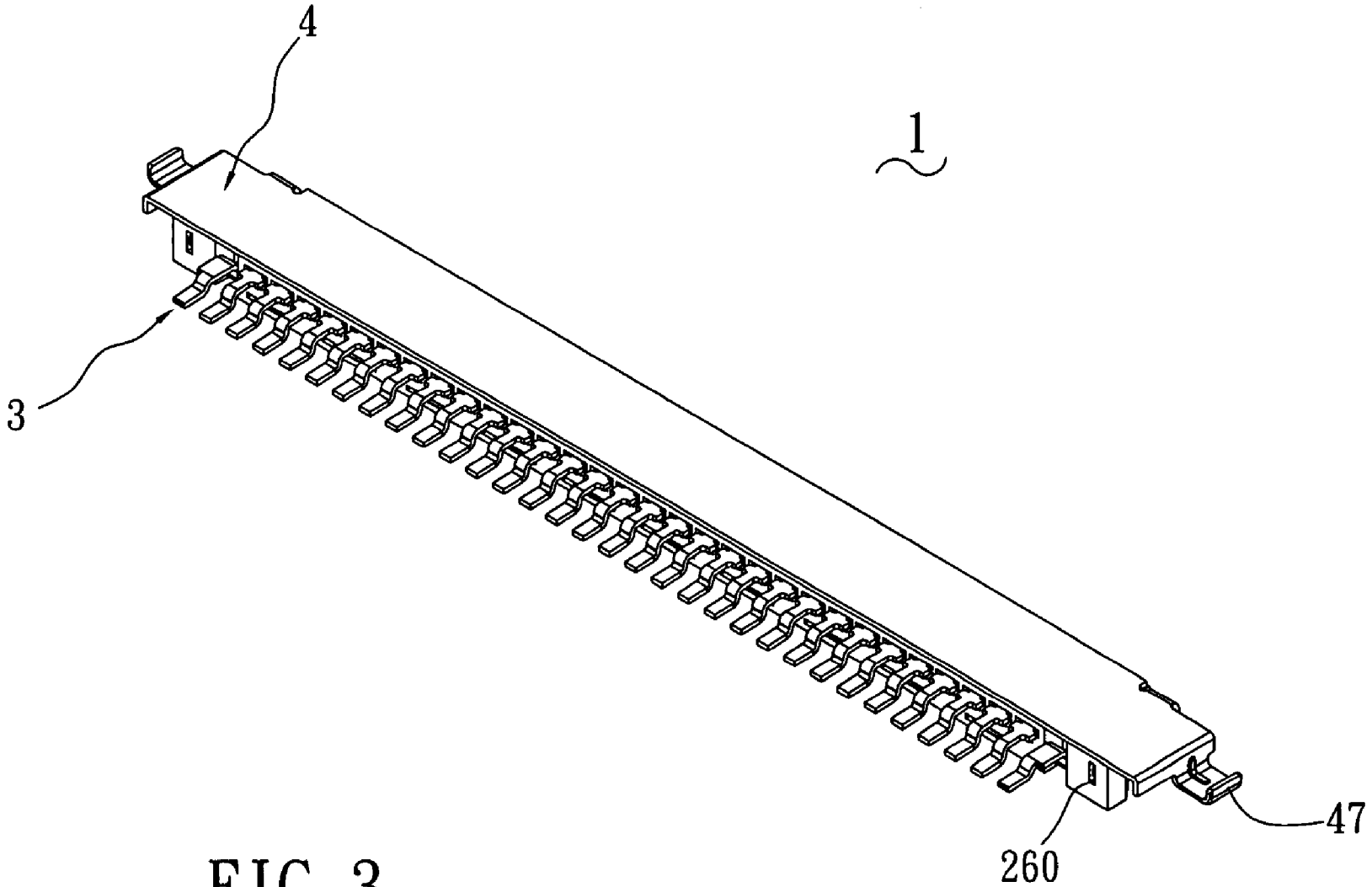
FIGS. 3 and 4 are assembled views of the thin connector of FIG. 1.
Figure 5:
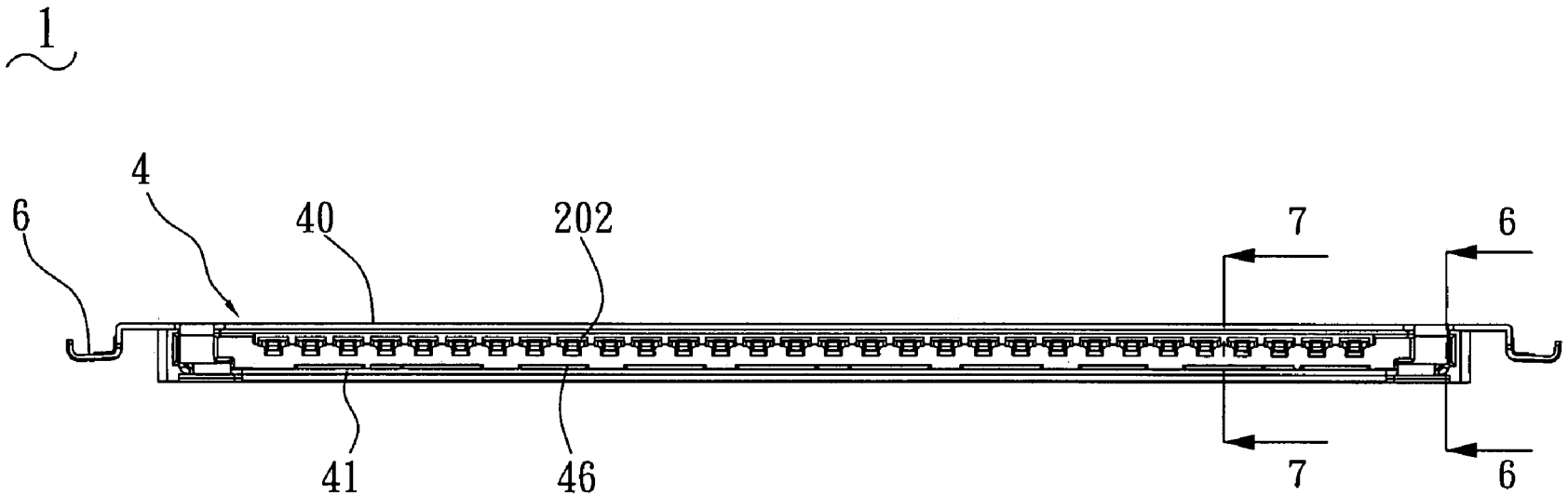
FIG. 5 is a front view of the thin connector of FIG. 4.

In combination with FIG. 5, the shell 4 has a top shielding wall 40 at a top, a bottom shielding wall 41 at a bottom, a pair of side shielding walls 42, 43 on both sides, assembling arms 44 on both sides for corresponding to the assembling holes 260, and ground pins 45. The top shielding wall 40 and the side shielding walls 42, 43 are respectively for shielding the top wall 22 and the side walls 24, 25 of the insulative housing 2. The top shielding wall 40, the side shielding walls 42, 43 together with the receiving space 27 define a locking groove (not labeled) for locking with the mating connector. The bottom shielding wall 41 is mounted inside the insulative housing 2 and forms a plurality of partitions 46 on a front side thereof for fitting to the plug holes 203. The number of the partitions 46 corresponds to that of the plug holes 203. Each partition 46 forms anchors 461 at opposite edges of a front end thereof for interferentially engaging with a plug hole 203. Referring to FIG. 2, the assembling arms 44 are integrally formed with and extend outwardly from the top shielding wall 40, bend substantially perpendicularly to reach the bottom shielding wall 41 and then perpendicularly bend and extend to cover the side shielding walls 42, 43. Each assembling arm 44 has a front portion 441 and a rear portion 442. Protuberances 443 are formed on the front portion 441 and are assembled inside the assembling holes 260 of the insulative housing 2. The rear portion 442 defines assembling grooves 444 therein for locking with the mating connector. The grounding pins 45 extend from the bottom shielding wall 41 of the shell 4, corresponding to the positioning notches 28, and have soldering portions 451 bending appropriately for facilitating surface mounting. A pair of soldering tails 47 respectively extends outwardly and bends perpendicularly from the side shielding walls 42, 43 for facilitating surface mounting. Three springy plates 48 (shown in FIG. 2) are formed on the bottom shielding wall 41 for firmly mating with the mating connector.

Figure 7:
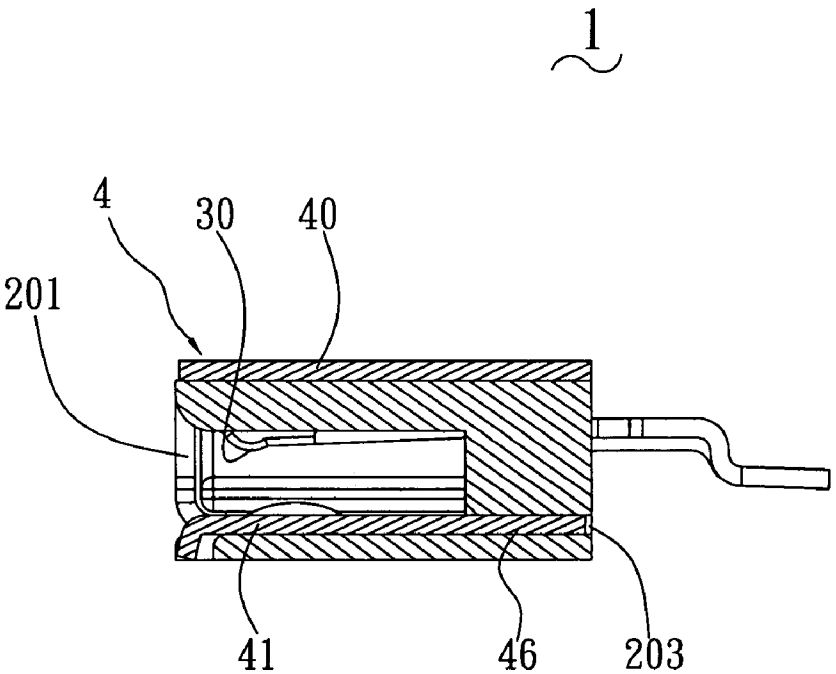
FIG. 7 is a cross-sectional view taken along the line 7—7 in FIG. 5.
Figure 6:
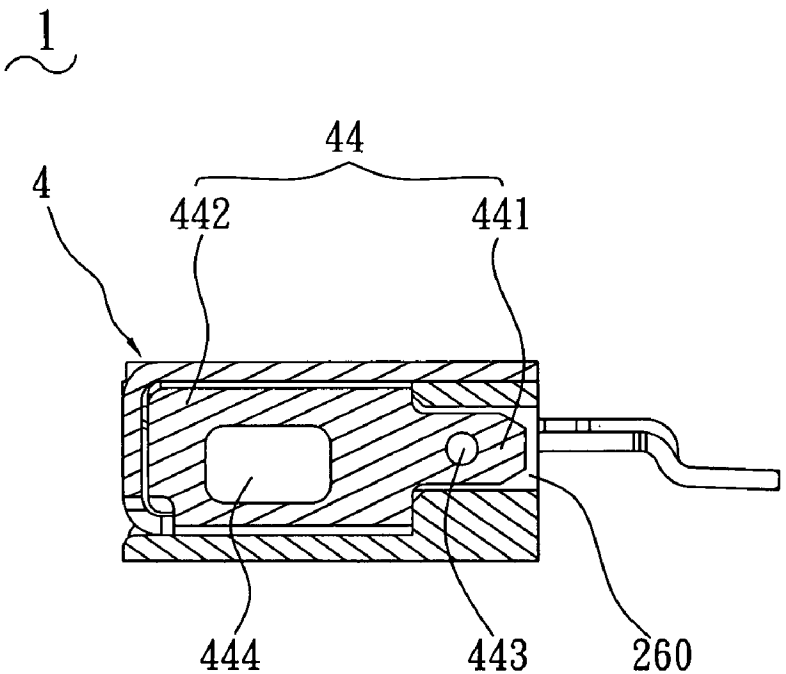
FIG. 6 is a cross-sectional view taken along the line 6—6 in FIG. 5.

Further referring to FIGS. 1–7, during assembly, the conductive terminals 3 are firstly inserted into the passageways 202 of the insulative housing 2. The shell 4 is mounted onto the opening 201 of the insulative housing 2. The protuberances 443 of the assembling arms 44 are assembled inside the assembling holes 260 of the insulative housing 2, as shown in FIG. 6. The partitions 46 are accommodated in the plug holes 203, as shown in FIG. 7. The overall height of the thin connector 1 is diminished because the bottom shielding wall 41 of the shell 4 is received inside the insulative housing 2. The partitions 46 shield below the contact portions 30 of the conductive terminals, and therefore the conductive terminals 3 are entirely shielded from cross talking. The capacity of the thin connector 1 increases to achieve impedance match for stable signal transmission. Moreover, the assembling grooves 444 of the assembling arms 44 latch with the mating connector, effectively avoiding disengagement.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A thin connector, comprising:

an insulative housing being substantially rectangular and having long sides and short sides, a mating wall and a connecting wall being respectively located at long side and opposite to each other, a top wall, a bottom wall and a pair of side walls being formed between the mating wall and the connecting wall, engaging blocks respectively extending outwardly from opposing ends of the connecting wall and defining receiving space toward the mating wall, wherein an opening being defined longitudinally through the mating wall for accommodating a mating connector, a plurality of passageways being transversely defined through the mating wall and the connecting wall, a plurality of plug holes being transversely defined below the passageways, each engaging block defining an assembling hole therein;

a plurality of conductive terminals received in the passageways, and each conductive terminal including a contact portion, a soldering portion and an interferential portion; and a shell forming a top shielding wall, a bottom shielding wall, a pair of side shielding walls and assembling arms for corresponding to the assembling holes of the insulative housing, wherein the bottom shielding wall being mounted inside the insulative housing, the assembling arms having front portions assembled inside the assembling holes of the insulative housing and assembling grooves being defined in rear portions of the assembling arms, the top shielding wall, the side shielding wall and the receiving space defining a locking groove for locking with the mating connector, wherein positioning notches are respectively defined in the insulative housing and adjacent to the side walls, wherein grounding pins extend from the bottom shielding wall of the shell, corresponding to the positioning notches, and have soldering portions bending appropriately for facilitating surface mounting, and wherein the assembling arms are integrally formed with an extend outwardly from the top shielding wall, and are bent substantially perpendicularly to reach the bottom shielding wall, then being perpendicularly bent again and extend to cover the side shielding walls, and wherein protuberances are formed on the front portion of the assembling arms.

2. The thin connector as claimed in claim 1, wherein a plurality of springy plates is formed on the bottom shielding wall.

3. The thin connector as claimed in claim 1, wherein a pair of soldering tails respectively extends outwardly and bends perpendicularly from the side shielding walls for facilitating surface mounting.

4. The thin connector as claimed in claim 1, wherein the soldering portion of the conductive terminal bends appropriately for surface mounting.

5. The thin connector as claimed in claim 1, wherein the assembling holes are upright and rectangular, and wherein the protuberances of the assembling arms are interferentially fitted to the assembling holes.

6. The thin connector as claimed in claim 5, wherein the plug holes are spaced equally apart from each other.

7. The thin connector as claimed in claim 6, wherein the number of the partitions corresponds to that of the plug holes, and wherein each partition forms anchors at opposite edges of a front end thereof for interferentially engaging with the plug holes.

* * * * *